US005180925A

United States Patent [19]

Lieb

[11] Patent Number: 5,180,925

[45] Date of Patent: Jan. 19, 1993

[54] REMOTE SWITCHING SYSTEM FOR AN ELECTRIC TROLLING MOTOR

[75] Inventor: Matthew J. Lieb, Northbrook, Ill.

[73] Assignee: Outboard Marine Corporation, Waukegan, Ill.

[21] Appl. No.: 659,851

[22] Filed: Feb. 22, 1991

[51] Int. Cl.[5] ..... H01H 35/01

[52] U.S. Cl. ..... 307/114; 200/86.5; 307/119; 307/122; 440/7

[58] Field of Search ..... 307/112, 113, 114, 119, 307/120, 122; 200/86.5; 74/560; 440/6, 7

[56] References Cited

U.S. PATENT DOCUMENTS

| | | | |
|---|---|---|---|
| 2,696,607 | 12/1954 | Witkin | 307/112 |
| 2,804,838 | 9/1957 | Moser | 440/7 |
| 2,828,379 | 3/1958 | Simonds et al. | 200/86.5 |
| 2,944,120 | 5/1960 | Ruben | 200/86.5 |
| 3,467,798 | 9/1969 | Krieger | 200/86.5 |
| 3,598,947 | 8/1971 | Osborn | 200/86.5 |
| 3,807,345 | 4/1974 | Peterson | 440/7 |
| 3,916,722 | 11/1975 | Grobe | 200/86.5 |
| 3,963,890 | 7/1976 | Straihammer | 200/86.5 |
| 3,970,984 | 7/1976 | Grubenmann | 200/86.5 |
| 4,172,217 | 10/1979 | Miller | 200/86.5 |
| 4,527,983 | 7/1985 | Booth | 440/7 |
| 4,587,388 | 5/1986 | Cavin | 200/86.5 |
| 4,824,408 | 4/1989 | Aertker et al. | 440/6 |
| 4,841,203 | 6/1989 | Gilbert | 318/53 |

*Primary Examiner*—Jeffrey A. Gaffin
*Attorney, Agent, or Firm*—Welsh & Katz, Ltd.

[57] ABSTRACT

A remote switching system for an electric trolling motor mounted to a boat includes at least one remote switching station secured to the boat and provided with a foot operated push-button switch actuator, the actuator configured for actuating the switch either momentarily or continuously by movement of the actuator by the operator's foot. A power circuit is designed to connect the remote switching station to the motor in a way which will conserve power and prevent corrosion.

6 Claims, 1 Drawing Sheet

REMOTE SWITCHING SYSTEM FOR AN ELECTRIC TROLLING MOTOR

BACKGROUND OF THE INVENTION

The present invention relates to switching systems for use with electrically powered outboard motors, and more specifically, to such a system designed to incorporate a foot switch actuator which enables the user to easily operate the motor either momentarily or in a continuous ON mode.

The use of electric outboard trolling motors on recreational fishing boats has become quite common. Such motors are used to quietly and often slowly maneuver the boat while fishing so as not to disturb the fish. Conventional electric trolling motors are either designed to be controlled at the tiller, in similar fashion to gasoline powered outboard motors, or by a foot switch secured to the bottom of the boat.

In the latter category, the majority of such switches incorporate momentary contact, push-button type switches which are wired to the motor so that the motor is activated only upon depression of the switch. A principal disadvantage of this type of switch is that the user must continually maintain foot pressure on the switch, a practice which quickly becomes fatiguing and tedious.

In some cases, the switches may be wired so that an initial depression turns the motor ON, and another depression is required to turn the motor off. This type of arrangement is disadvantageous due to the inability of momentarily activating the trolling motor. If desired, additional switches may be provided to remotely control the tiller and steer the boat.

Switching systems have been disclosed which incorporate a foot operated, U-shaped lock-on bracket for use with momentary push button ON systems. However, in that the manipulation of the bracket is not a standard movement for the human foot, such switches may be awkward to manipulate, especially if the user is wearing heavy shoes or waterproof boots.

A further disadvantage of conventional remote switching systems for trolling motors is the inability of adding additional remote switching stations, for instance when such systems are installed on larger boats.

Yet another drawback of conventional remote trolling motor switching systems is that the remote stations are wired so that heavy gauge cable is used between the switch and the battery, and between the switch and the motor. The relatively high current flow through the cables in the high moisture environment of boat bottoms promotes corrosion.

Thus, there is a need for a remote switching system for use with electric outboard trolling motors which is equipped with a remote switching station having a momentary motor control, as well as an easily manipulated lock-ON feature. There is also a need for such a system which is capable of including multiple remote switching stations, and which is wired in such a way that corrosion is inhibited.

SUMMARY OF THE INVENTION

Accordingly, a remote switching system for an electric trolling motor mounted to a boat includes at least one remote switching station secured to the boat and provided with a foot operated push-button switch actuator, the actuator configured for actuating the switch either momentarily or continuously by movement of the actuator by the operator's foot. The motor is operated momentarily by the user depressing his foot, and is operated continuously by a pushing and twisting motion of the operator's foot. In addition, a power circuit employing a relay is designed to connect the remote switching stations to the motor in a way which will conserve power and prevent corrosion.

DETAILED DESCRIPTION OF THE PREFERRED EMBODIMENT

Figure 1:
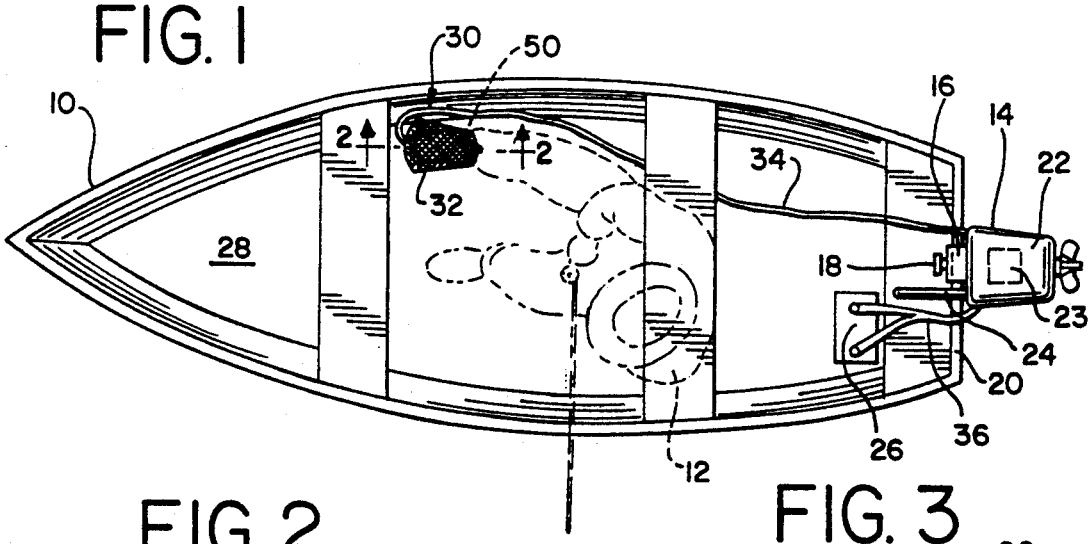
FIG. 1 is a plan view of a boat with an electrically driven outboard motor secured thereto, showing a fisherman in phantom using the present remote controlled switching system.

Referring now to the drawing, wherein like reference numerals indicate identical features, FIG. 1 depicts a boat 10 carrying a fisherman/operator 12 and is provided with an electric outboard trolling motor 14. A U-shaped clamp 16 having a clamp screw 18 is used to secure the motor 14 to the transom 20 of the boat 10. The motor 14 is provided with an upper housing 22 which encloses the control head diagrammatically shown hidden at 23. It is contemplated that the motor 14 may be provided in any one of a number of conventional configurations, and the motor configuration depicted in FIG. 1 is merely intended to be representative of electric trolling motors in general.

A tiller 24 is secured to the motor 14 and is utilized in steering the boat 10. Electrical power to the motor 14 is provided by a battery 26 which is preferably of the wet cell automotive type. The battery 26 is shown positioned on the floor 28 of the boat 10; however, battery brackets (not shown) located on the inner walls of the boat are contemplated as an alternate battery support system.

The present remote switching system is generally designated 30 and includes at least one remote switching station 32. Each station 32 is electrically connected to the motor 14 by a cable 34, and the battery 26 is connected to the motor 14 by a cable 36.

Figure 2:
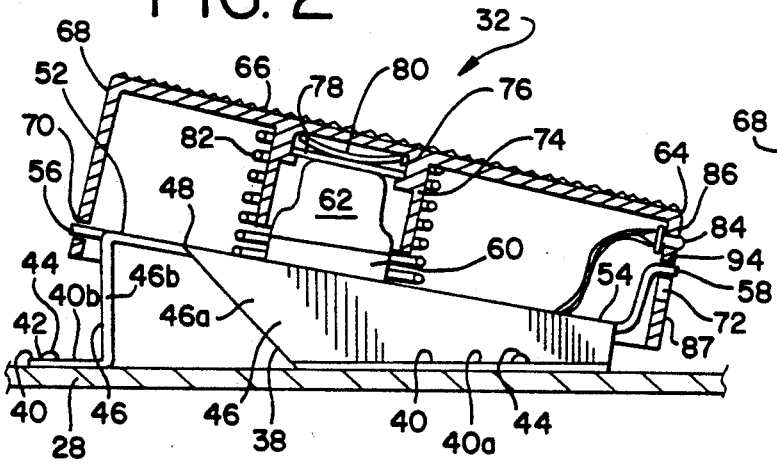
FIG. 2 is a sectional elevation taken along the line 2—2 of FIG. 1 and in the direction indicated generally.
Figure 3:
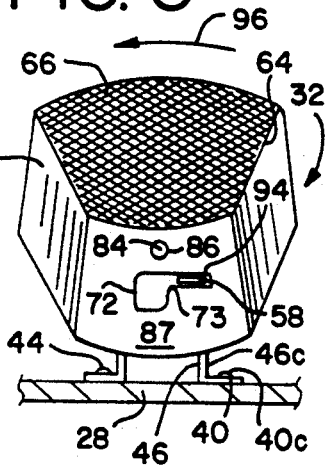
FIG. 3 is a front perspective elevational view of the switch depicted in FIG. 2.

Referring now to FIGS. 2 and 3, each station 32 basically consists of a remote foot switch having a base bracket 38 which in the preferred embodiment is a metal stamping; however, other bracket configurations are contemplated. The bracket 38 has at least one lower flange 40 provided with at least one mounting hole 42 through which a corresponding fastener 44 such as a screw, bolt or rivet is inserted to secure the bracket 38 to the floor 28 of the boat 10. In the preferred embodiment, there are three such flanges 40, designated 40*a*, 40*b* and 40*c*, each having corresponding mounting holes 42 and fasteners 44.

The bracket 38 also includes at least one leg 46 which connects a corresponding flange 40 to an upper mounting surface 48. In the preferred embodiment, there are three legs 46 to correspond with the three flanges 40, the legs being designated 46*a*, 46*b* and 46*c*. The surface 48 is preferably disposed on aslight incline to facilitate comfortable manipulation by the operator's foot 50 (shown in phantom in FIG. 1). It is preferred that the surface 48 be inclined so that a rear end 52 is higher than a front end 54.

A lip 56 projects laterally, in this case rearwardly, from the mounting surface 48, and curved, tab-like tongue 58 is formed to project laterally and opposite to the lip 56, in this case forwardly from the mounting surface. A momentary contact-type switch 60 is mounted to the surface 48 in a preferably central position, and is provided with a rubber boot 62 for moisture protection. The switch 60 is electrically connected to the motor 14 by the cable 34 in conventional fashion.

The switching station 32 also includes a pedal 64 having an upper gripping surface 66 and a peripheral depending skirt 68. In the preferred embodiment, the pedal 64 is a single piece of molded plastic, although pedals made of steel, cast aluminum, or other materials are also contemplated. The skirt 68 depends low enough to cover and provide some protection to the mounting surface 48 and the switch 60. The gripping surface 66 is configured to be non-slip, and as such may have a textured surface and/or may be relatively softer, or may have a softer covering than the remainder of the pedal 64. The skirt 68 is provided with an elongate, generally horizontal rear slot 70 configured to be slidingly engaged by the rear lip 56, and a cam-shaped front opening 72 configured to receive the tongue 58. The opening 72 includes a lower cam surface 73.

An underside of the gripping surface 66 has a depending tubular formation 74 dimensioned to encompass at least the rubber boot 62 of the switch 60. The tubular formation 74 includes an upper recess 76 which is constructed to retain a flat washer 78 disposed below a wave washer 80. The wave washer 80 provides both overstroke capability and a slip surface between the flat washer 78 and the pedal 64. In addition, the flat washer 78 acts as a retainer for the wave washer 80 and as a slip surface between the wave washer and the booted switch 60.

A coiled spring 82 is disposed to circumscribe the tubular formation 74 and to seat at a lower end against the upper mounting surface 48 of the bracket 38, and at an upper end against the underside of the gripping surface 66. In this manner, the spring 82 biases the pedal 64 in an upward direction away from the surface 48. It will be appreciated that the rear slot 70 in the pedal skirt 68 is long enough to slidingly accommodate the degree of lateral movement of the pedal 64 as the slot passes across the rear lip 56, and also prevents the pedal from separating from the bracket 38 under the biasing force of the spring 82.

If desired, the pedal 64 may be provided with a visual indicator 84 such as an LED or an incandescent bulb which is visible to the operator 12 when the switch 60 is in an ON position. Such an indicator 84 may be particularly useful on larger boats when several switching stations 32 are employed, making it difficult to otherwise determine which station is being used to control the motor 14. In the preferred embodiment, the indicator 84 is an LED which projects through a corresponding opening 86 in a front panel 87 of the skirt 68.

Figure 4:
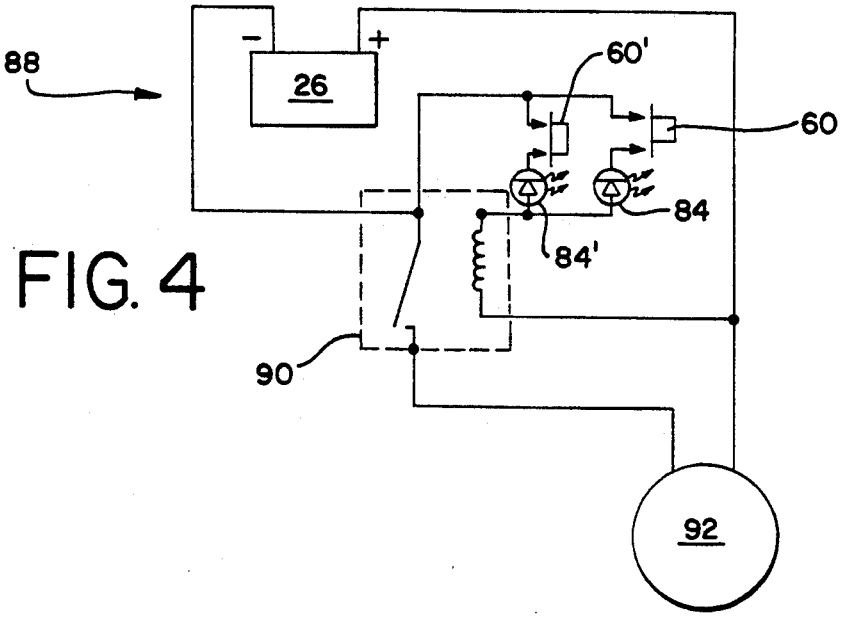
FIG. 4 is an electrical schematic of the circuit used in the present switching system.

Referring now to FIG. 4, a preferred electrical schematic for the switching circuit used with the present switching system is shown, and is generally indicated at 88. The battery 26 is shown connected to the switch 60 by means of a relay 90, which, in the preferred embodiment is a sealed 12 volt, 40 amp switching relay. An advantage of the relay 90 is that it achieves reduction in power losses due to switch contact resistance, as well as to corrosion. In addition, the use of the relay 90 allows the remote switch 60 and its wiring to be of low current design, which lowers the expense of each station 32 and facilitates installation. The relay 90 is actually mounted in the control head 23 of the motor 14 to keep the system compact, shorten the main power wires, and protect the motor circuit 92 from standing water.

The relay 90 is connected in series with the motor circuit 92 and the battery 26 to allow the operator 12 to run the motor 14 from one or more remote switching stations 32. Such multiple stations are represented as switch 60' in FIG. 4. If additional remote switches 60' are to be used, they are wired in parallel with the switch 60. The motor circuit 92 includes components for regulating motor functions including speed, direction, and operating voltage, such components being commonly known to skilled practitioners. If provided, the LED indicator 84 is connected in series with the switch 60, and it is contemplated that additional LEDs 84' will be provided as switches 60' are added.

In operation, and referring to FIGS. 1-3, the switching station 32 is disposed on the floor 28 of the boat 10 to be easily accessible by the foot 50 of the fisherman/operator 12. If the fisherman 12 wishes to momentarily activate the motor 14, he merely depresses the pedal 64 to overcome the biasing force of the spring 82 and thereby actuate the switch 60. In this situation, the motor 14 (and for that matter, the indicator 84) will only remain ON as long as the pedal 64 is depressed. If the fisherman 12 desires that the motor 14 (and, likewise, the indicator 84) remains ON for an extended length of time, he depresses the pedal 64 as before, and then rotates his foot 50 so that the tongue-tab 58 acts as a cam follower along the cam surface 73 and becomes lodged in a narrower portion 94 of the front cam opening 72.

Referring now to FIG. 3, in order to lock the switch 60 ON, the pedal 64 would be depressed and rotated slightly in a counterclockwise direction as indicated by the arrow 96. It is contemplated, however, that the switching station 32, and especially the front cam opening 72, could be configured to be locked ON by rotating the pedal 64 in a clockwise direction.

As soon as the operator 12 wishes to turn the motor 14 OFF, the pedal 64 is depressed and rotated in the opposite direction to dislodge the tongue 58 from the narrower opening 94. This action releases the pedal 64 and, through the action of the spring 82, returns the switch 60 to an OFF position. If desired, additional remote switching stations 32 may be added for larger boats and when additional fishermen are present.

Thus, the present remote switching system is protected from moisture, is inexpensive to produce and assemble, and is comfortable for the fisherman to operate, either in a momentary or locked ON mode. Furthermore, it may be easily expanded for use on larger boats.

While a particular embodiment of the remote switching system for an electric trolling motor of the invention has been shown and described, it will be appreciated by those skilled in the art that changes and modifications may be made thereto without departing from the invention in its broader aspects and as set forth in the following claims.

What is claimed is:

1. A remote switching system for an electric trolling motor mounted in a boat, comprising:

an electric trolling motor having a control head;

a portable source of electric power;

at least one remote switching station adapted to be mounted to the boat and being connected to said motor and to said power source, each said station including a foot-operated actuator means operationally associated with a push-button switch, and said actuator having locking means incorporated therein for releasably locking said switch in a closed position when said actuator means is depressed momentary operaton of said trolling motor or is depressed and rotated for locked ON operation of said trolling motor.

2. The switching system as defined in claim 1 wherein each of said switching stations is connected to said motor by a relay.

3. The switching system as defined in claim 2 wherein said relay is located in said control head of said motor.

4. The switching system as defined in claim 1 including a plurality of switching stations, each said station being connected to adjacent stations in parallel.

5. The switching system as defined in claim 1 including a plurality of switching stations, and wherein each of said switching stations is provided with indicator means for indicating whether a particular station is activated.

6. The switching system as defined in claim 1 wherein said foot-operated actuator means is a pedal, said push button switch is mounted to a bracket, and said locking means includes a cam slot on said pedal and a cam follower tongue on said bracket adapted to matingly engage said cam slot.

* * * * *

UNITED STATES PATENT AND TRADEMARK OFFICE

CERTIFICATE OF CORRECTION

PATENT NO. : 5,180,925

DATED : January 19, 1993

INVENTOR(S) : Matthew J. Lieb

It is certified that error appears in the above-indentified patent and that said Letters Patent is hereby corrected as shown below:

Column 2, line 66, delete "aslight" and insert --a slight--; and

Column 4, line 23, after "fisherman" delete the hyphen.

Column 5, line 10, after "pressed" insert --for--.

Signed and Sealed this

Twenty-fifth Day of January, 1994

*Attest:*

Bruce Lehman

BRUCE LEHMAN

*Attesting Officer*

*Commissioner of Patents and Trademarks*